US008826673B2

(12) United States Patent
Mak

(10) Patent No.: US 8,826,673 B2
(45) Date of Patent: Sep. 9, 2014

(54) AMBIENT AIR VAPORIZER

(75) Inventor: John Mak, Santa Ana, CA (US)

(73) Assignee: Fluor Technologies Corporation, Aliso Viejo, CA (US)

( * ) Notice: Subject to any disclaimer, the term of this patent is extended or adjusted under 35 U.S.C. 154(b) by 1184 days.

(21) Appl. No.: 12/523,685

(22) PCT Filed: Sep. 17, 2007

(86) PCT No.: PCT/US2007/020135

§ 371 (c)(1),
(2), (4) Date: Aug. 19, 2009

(87) PCT Pub. No.: WO2008/094220

PCT Pub. Date: Aug. 7, 2008

(65) Prior Publication Data

US 2010/0043453 A1 Feb. 25, 2010

Related U.S. Application Data

(60) Provisional application No. 60/899,292, filed on Feb. 1, 2007.

(51) Int. Cl.

| | |
|---|---|
| ***F17C 9/02*** | (2006.01) |
| ***F17C 9/04*** | (2006.01) |
| ***F25D 21/06*** | (2006.01) |
| ***F17C 5/06*** | (2006.01) |

(52) U.S. Cl.

CPC ..... *F17C 5/06* (2013.01); *F17C 2227/0393* (2013.01); *F17C 2221/033* (2013.01); *F17C 2225/0123* (2013.01); *F17C 2260/032* (2013.01); *F17C 2225/035* (2013.01); *F17C 2227/0135* (2013.01); *F17C 2227/0311* (2013.01); *F17C 2223/0161* (2013.01); *F17C 9/02* (2013.01); *F17C 2265/05* (2013.01); *F17C 2223/033* (2013.01); *F17C 2265/022* (2013.01)

USPC ..... 62/50.4; 62/50.2; 62/275

(58) Field of Classification Search

CPC ..... F17C 5/06; F17C 7/04; F17C 9/02; F17C 9/04; F17C 2227/0135; F17C 2227/031; F17C 2227/0393; F17C 2260/032; F17C 2265/022; F17C 2227/0311; F17C 2227/0327; F17C 2265/05; F17C 2221/033; F17C 2223/0161; F17C 2223/033; F17C 2225/0123; F17C 2225/035

USPC ..... 62/275, 50.2, 50.4

See application file for complete search history.

(56) References Cited

U.S. PATENT DOCUMENTS

| | | | | |
|---|---|---|---|---|
| 2,750,753 | A * | 6/1956 | Armstrong | 62/50.6 |
| 5,267,446 | A | 12/1993 | Viegas et al. | |
| 6,089,028 | A | 7/2000 | Bowen et al. | |
| 6,557,535 | B2 | 5/2003 | Stone | |

(Continued)

FOREIGN PATENT DOCUMENTS

| | | | |
|---|---|---|---|
| GB | 2143022 | A * | 1/1985 |
| JP | 60-43797 | | 3/1985 |

(Continued)

*Primary Examiner* — Frantz Jules
*Assistant Examiner* — Keith Raymond
(74) *Attorney, Agent, or Firm* — Fish & Tsang, LLP

(57) ABSTRACT

Contemplated systems and methods employ a portion of vaporized and heated LNG as a defrosting medium in an LNG ambient air vaporizer. Most preferably, the LNG is heated to a temperature of about 100° F. to 400° F., and is after defrosting fed back to the LNG stream at a position that is upstream and/or downstream of the vaporizer or to the natural gas delivery pipeline.

14 Claims, 2 Drawing Sheets

(56) References Cited

U.S. PATENT DOCUMENTS

| | | | |
|---|---|---|---|
| 2004/0154315 | A1 | 8/2004 | Bernet |
| 2007/0130963 | A1 | 6/2007 | Morrison et al. |
| 2007/0144184 | A1 | 6/2007 | Wijingaarden et al. |

FOREIGN PATENT DOCUMENTS

| | | |
|---|---|---|
| JP | 60-168994 | 9/1985 |
| JP | 62-171597 | 7/1987 |
| JP | 2005-220980 | 8/2005 |

* cited by examiner

AMBIENT AIR VAPORIZER

This application claims priority to our copending U.S. provisional patent application with the Ser. No. 60/899292, which was filed Feb. 1, 2007.

FIELD OF THE INVENTION

The field of the invention is liquefied natural gas (LNG) regasification, and especially configurations and methods of operation and defrosting of ambient air vaporizers and heaters at LNG regasification terminals.

BACKGROUND OF THE INVENTION

Atmospheric air vaporizers (ambient air vaporizers) are well known in the art and are used in many cryogenic liquid plants to vaporize cryogenic liquids, such as liquid nitrogen for industrial usage. In most cases, ambient air vaporizers are based on a heat exchanger which uses sensible heat of ambient air and/or latent heat of water in the environment to heat a low boiling point liquid (e.g., liquid oxygen, liquid nitrogen, etc.). The vaporization duty of these vaporizers is relatively small when compared to the large duties required by LNG regasification terminals. Therefore, application of known ambient air vaporizers for regasification of LNG requires a rather significant large plot space, which is uneconomical and/or impractical, especially in offshore and floating LNG regasification facilities.

State of the art ambient air vaporizers/heat exchangers typically include a number of individual multi-finned heat transfer elements in various serial and/or parallel configurations. Such finned heat exchangers are relatively efficient for transferring heat from the ambient air to vaporize and superheat LNG due to the large temperature difference between ambient air and LNG. Most of these exchangers are in vertical orientation and have counter current flow between the downward cold denser air (due to gravitational force) and the upward flow of the LNG in the vaporizer tubes. For example, U.S. Pat. Nos. 4,479,359 and 5,252,425 show exemplary configurations for ambient air vaporizers. Further known and similar LNG regasification configurations are described in U.S. Pat. App. No. 2006/0196449, U.S. Pat. No. 7,155,917, and JP 05312300.

In all of such known ambient exchangers, ice tends to accumulate on the outer fins, and particularly in the lower parts of the exchangers at which the LNG enters. The formation of ice layers on the exchanger fins impedes the heat transfer process. Moreover, the so formed ice layers may be unevenly distributed along the tubes, which adds weight to the exchangers and may even change the center of gravity of the exchanger. Excessive ice layer formation is particularly problematic where stringent structural code requirements for wind and seismic loads need to be met.

Where ice layers have already built up to an unacceptable level that reduces the overall heat transfer, the LNG vaporization process must often be stopped and the exchangers are then placed on a standby de-icing cycle. In most cases, de-icing is done by natural draft convection, which is very time consuming. To reduce de-icing time, force draft air fans may be employed. However, such operation reduces the defrosting time only marginally as heat transfer is limited by the ice layer that acts as an insulator. The use of forced air fan is also difficult to be justified due to additional cost and energy consumption of the air circulation fans. Typically, over one-third of the ambient air vaporizers are on defrosting and the other two-third are on LNG regasification. Furthermore, performance of such known ambient air vaporizers are sensitive to changes in environmental factors such as variations in humidity and dry bulb temperature, ambient temperature fluctuations, relative humidity, wind, solar radiation, and/or surrounding structures.

Therefore, while numerous configurations and methods of ambient air vaporization of LNG are known in the art, all or almost all of them suffer from one or more disadvantages. Thus, there is still a need to provide improved configurations and methods for regasification of LNG.

SUMMARY OF THE INVENTION

The present invention is directed to configurations and methods of LNG regasification in which LNG is regasified in ambient air vaporizers that are defrosted using a heated portion of vaporized LNG as the defrosting medium. Most preferably, the heated portion is also used in adjusting/maintaining the temperature of the vaporized LNG prior to delivery to a natural gas sales pipeline, and the chilled defrost gas from the defrosting conduits is routed to the natural gas pipeline and/or recycled back to the LNG stream.

In one aspect of the inventive subject matter, an LNG regasification system comprises multiple ambient air vaporizers with an LNG source that delivers LNG to first and second ambient air vaporizers configured to produce vaporized LNG. A heater is fluidly coupled to the first and second vaporizers and is configured to receive and heat some of the vaporized LNG to a temperature at or above ambient temperature. First and second ambient air vaporizers are thermally coupled to respective first and second defrosting conduits that are configured to receive at least a portion of the heated vaporized LNG to thereby (a) allow defrosting of the first and second ambient air vaporizers and (b) form chilled vaporized LNG. Contemplated plants further include first and second recycle conduits that are fluidly coupled to the first and second defrosting conduits and that are configured to feed the chilled vaporized LNG to a conduit transporting the vaporized LNG and/or a conduit transporting the LNG.

Most preferably, the system is configured to allow alternate operation of the first and second ambient air vaporizers, and/or to allow combination of another portion of the heated vaporized LNG with the vaporized LNG for temperature control of the vaporized final product. Where desired, contemplated plants include a compressor that compresses chilled vaporized LNG from the vaporizers, typically to pipeline pressure. In such plants, a first conduit may be provided that allows combination of at least some of the compressed chilled vaporized LNG with the heated vaporized LNG and/or a second conduit may be provided that allows combination of a portion of the compressed chilled vaporized LNG with LNG at a position upstream of the first and second ambient air vaporizers. Alternatively, a pressure differential valve may be implemented downstream of and fluidly coupled to the first and second ambient air vaporizers. Such valve is typically configured to allow a predetermined flow of heated vaporized LNG to the first and second ambient air vaporizers. Among other advantages, it should be noted that such configurations will typically not require a compressor and thus may be more economical. Where desired, first and second recycle conduits will be configured in such plants to feed the chilled vaporized LNG to the conduit transporting the vaporized LNG at a position downstream of the pressure differential valve.

Therefore, in another aspect of the inventive subject matter, a method of regasifying LNG will include a step of feeding LNG to a first ambient air vaporizer to produce vaporized LNG, and another step of heating at least some of the vaporized LNG to a temperature above ambient temperature (e.g., between 100° F. and 400° F.). Where desired, the chilled vaporized LNG is compressed to pipeline pressure and at least a portion of the compressed chilled vaporized LNG is fed to (a) an LNG stream at a position upstream of both vaporizers, (b) the heated portion of the vaporized LNG, and/or (c) the vaporized LNG exiting the first ambient air vaporizer. In such methods, it is especially preferred that the compressed chilled vaporized LNG is combined with the heated portion of the vaporized LNG in an amount effective to control the temperature of the heated portion of the vaporized LNG. Alternatively, a pressure differential valve may be provided to regulate an upstream flow of the vaporized LNG to the heater, with the chilled vaporized LNG from the defrosting conduct returning to a point downstream of the pressure differential valve. In further contemplated methods, the defrosting operation and the vaporization may be performed contemporaneously in the same vaponzer.

Therefore, and viewed from a different perspective, the inventor also contemplates use of heated vaporized LNG to provide heat content for defrosting of an ambient air vaporizer in a plant in which LNG is vaporized, wherein the plant is configured to allow combination of the heated vaporized LNG with the LNG and/or the vaporized LNG after it has provided the heat content for the defrosting operation. Additionally, the heated vaporized LNG may also be employed to control the temperature of the vaporized product prior to entry to a delivery pipeline. In preferred uses, the heated vaporized LNG has a temperature of between 100° F. and 400° F., and the plant is configured to allow combination of the heated vaporized LNG with the vaporized LNG after the heated vaporized LNG has provided the heat content.

Various objects, features, aspects and advantages of the present invention will become more apparent from the following detailed description of preferred embodiments of the invention.

DETAILED DESCRIPTION

Figure 1:
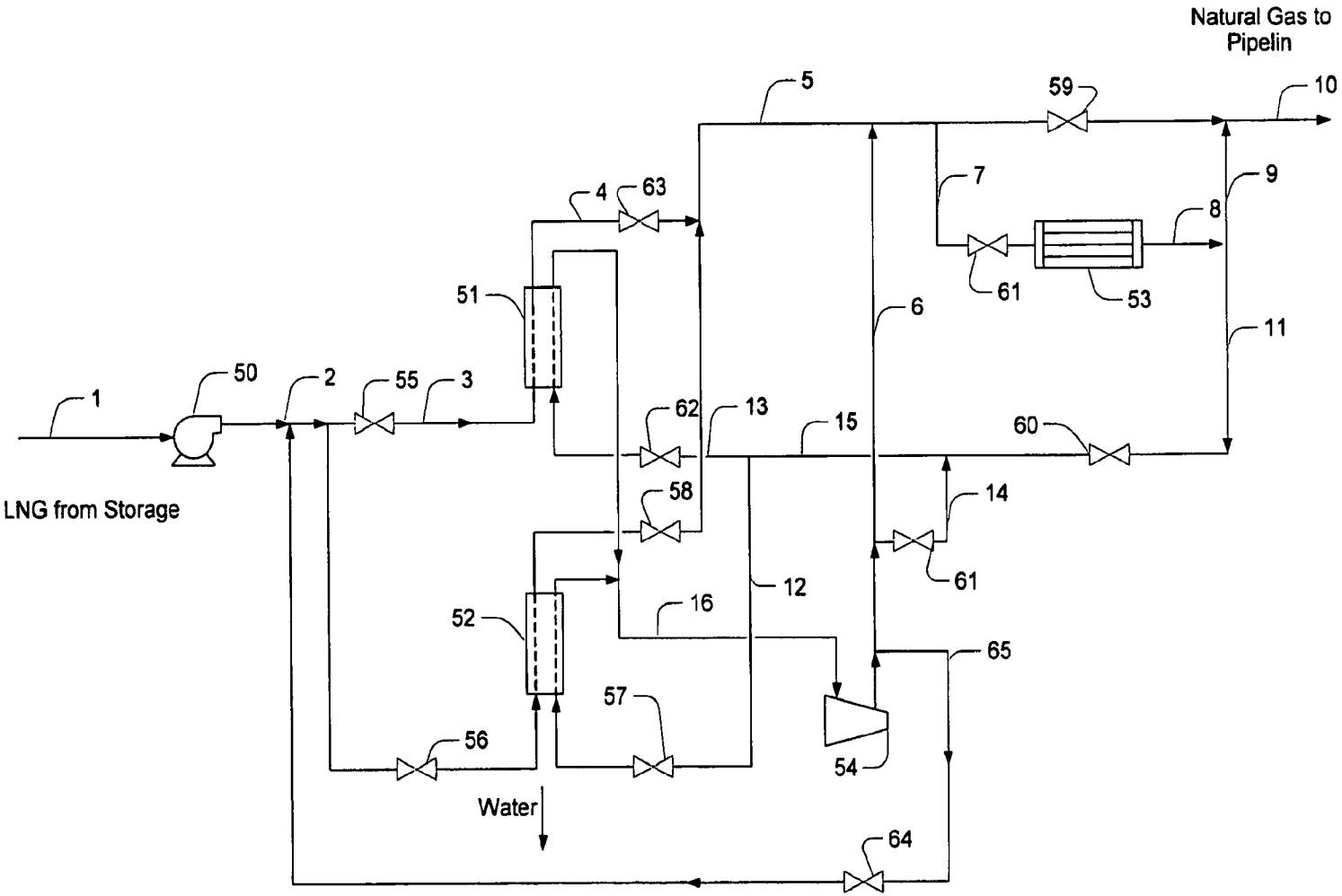
FIG. 1 is a schematic of a first exemplary configuration for an LNG regasification plant with recompression of chilled defrosting gas.

The inventor has discovered that ambient air vaporizers can be defrosted in various configurations and methods in which a portion of the vaporized LNG is heated by an external heat source to so provide a defrosting medium to the vaporizers. Most preferably, the chilled defrosting medium is recycled to the LNG ambient vaporizer defrosting operation. It should be appreciated that such configurations require significantly less defrosting time, and therefore reduce heat exchanger size and plant footprint. Furthermore, it should be recognized that configurations and methods contemplated herein are especially advantageous in LNG terminals where plot space is at a premium (e.g., offshore and floating LNG regasification terminals) as, among other factors, the defrosting circuitry is integrated with the vaporization process.

In generally preferred aspects, contemplated methods and configurations for ambient air vaporization comprise a step of boosting the LNG pressure to at least pipeline pressure, and heating the pressurized LNG in ambient air heaters in which the LNG is evaporated in a conventional heating cycle. At least a portion of the so vaporized natural gas is then further heated using an external heat source (typically during the defrosting and de-icing cycle). It is typically preferred that the ambient air vaporizers have vertical tube orientation, wherein the tubes are heated in two modes in the defrosting cycle: Ambient air in natural convection mode on the outside and heated natural gas heating on the inside (which may or may not be the lumen in which LNG is vaporized). Such dual heating will significantly reduce de-icing time and energy requirements over heretofore known devices and methods.

In an especially preferred configuration, the heated natural gas is routed to the bottom of a vertical ambient air vaporizer where accumulation of ice layers is most severe due to the cryogenic LNG inlet temperature (typically at about −260° F.). Alternatively, the heated natural can be routed to the top of the exchanger where the temperature difference between the defrost gas and the exchanger is the lowest and hence less thermal stress on the equipment. When the tube wall in the lower section is warmed to above 32° F., the ice layer next to the tubes or fins will melt, and the ice will drop from the exchanger tube. Where multiple vaporizers are operated, it is contemplated that the chilled natural gas from one defrosting exchanger can be returned to the inlet or outlet of another ambient air vaporizer or directly to the delivery pipeline depending on the temperatures during the defrosting cycle. Furthermore, at least a portion of the chilled vaporized LNG may also be used for temperature control in one or more LNG streams in the regasification plant. It should be noted that the so produced ice and water from the defrosting is of relatively high purity and can be recovered for residential or industrial consumption, or be directly discharged to the ocean or other locale without environmental concerns.

One exemplary contemplated process for ambient air LNG vaporizers is schematically depicted in FIG. 1 in which LNG stream I from an LNG storage tank or other source (e.g., LNG transporter or ship) is typically at a pressure of between about 70 psig to 100 psig and at a temperature of about −260° F. to −250° F. Stream 1 is pumped by LNG pump 50 to a suitable pressure, typically about 1200 to 1600 psig to form pressurized LNG stream 2, as needed to meet local pipeline pressure requirements. The LNG flow rate of stream 3 is controlled using valve 55 and fed to ambient air vaporizer 51 forming stream 4 in which the vaporized LNG is at a temperature of about 40° F. During the LNG heating cycle for ambient air vaporizer 51, exchanger inlet valve 55 and outlet valve 63 are open, while valve 62 (used for the defrosting function) is closed.

The vaporized LNG stream 5 is mixed with stream 6 that is recycled from defrosting compressor 54. During cold ambient operation, a portion of vaporized gas, stream 7, is routed via valve 61 to an external heater 53 that heats stream 7 to a temperature of typically about 100° F. to 400° F., forming stream 8. Stream 8 is further split into two portions: Stream 9 is mixed with the vaporized LNG forming stream 10 to a temperature suitable for transmission in natural gas pipelines, while stream 11 is fed via valve 60 to a vaporizer in defrosting mode. Most typically, stream 11 is mixed with at least a portion of a recycle gas stream 14 (flow rate is controlled by valve 61) such that stream 15 is maintained at a predetermined and optimum temperature for the defrosting operation at exchanger 52. Most preferably, the temperature profile in the defrosting exchanger 52 will be maintained to minimize thermal stress in the exchangers. During warm ambient operation, the use of heater 53 may be discontinued with respect to regulation of the temperature of stream 10. In such scenario, ambient air vaporizer outlet (stream 5) can be directly injected via valve 59 to the gas pipeline (stream 10), while heated vaporized LNG stream 11 is used in defrosting. In this operation, the chilled vaporized LNG stream from the defrosting operation is compressed and recycled as stream 65 via valve 64 to a position upstream of the inlet of the ambient air vaporizer 51.

During the defrosting cycle of exchanger 52, LNG inlet valve 56 and outlet valve 58 are closed while the defrosting valve 57 is open, allowing the heated vaporized LNG stream 12 (at an optimum defrosting temperature) to enter at or near the bottom of the vertical exchanger where ice accumulation is the most severe. The defrosting gas flows upwards in the exchanger tubes (or tubes in thermal exchange with the vaporizer fins or other vaporizer surface) while the ice layers on the outer fins are melted. It should be appreciated that melting of the ice layers occurs preferentially in the lower tubes and the weight of the melted ice naturally allows removal by gravity. Similarly, during the defrosting cycle of exchanger 51, LNG inlet valve 55 and valve 63 are closed while the defrosting valve 62 is open, allowing heated vaporized LNG stream 13 to provide heat content for defrosting exchanger 51. Most preferably, the chilled vaporized LNG stream 16 is compressed by compressor 54 and is split into three portions, streams 65, 14, and 6. Stream 65 is routed to the inlet of the ambient air vaporizer 51 for vaporization with stream 2, stream 14 is mixed with the heated vaporized LNG to realize and/or maintain optimum defrosting temperatures, and stream 6 is combined with the vaporized LNG, preferably in a position upstream of the heater and/or pipeline.

Figure 2:
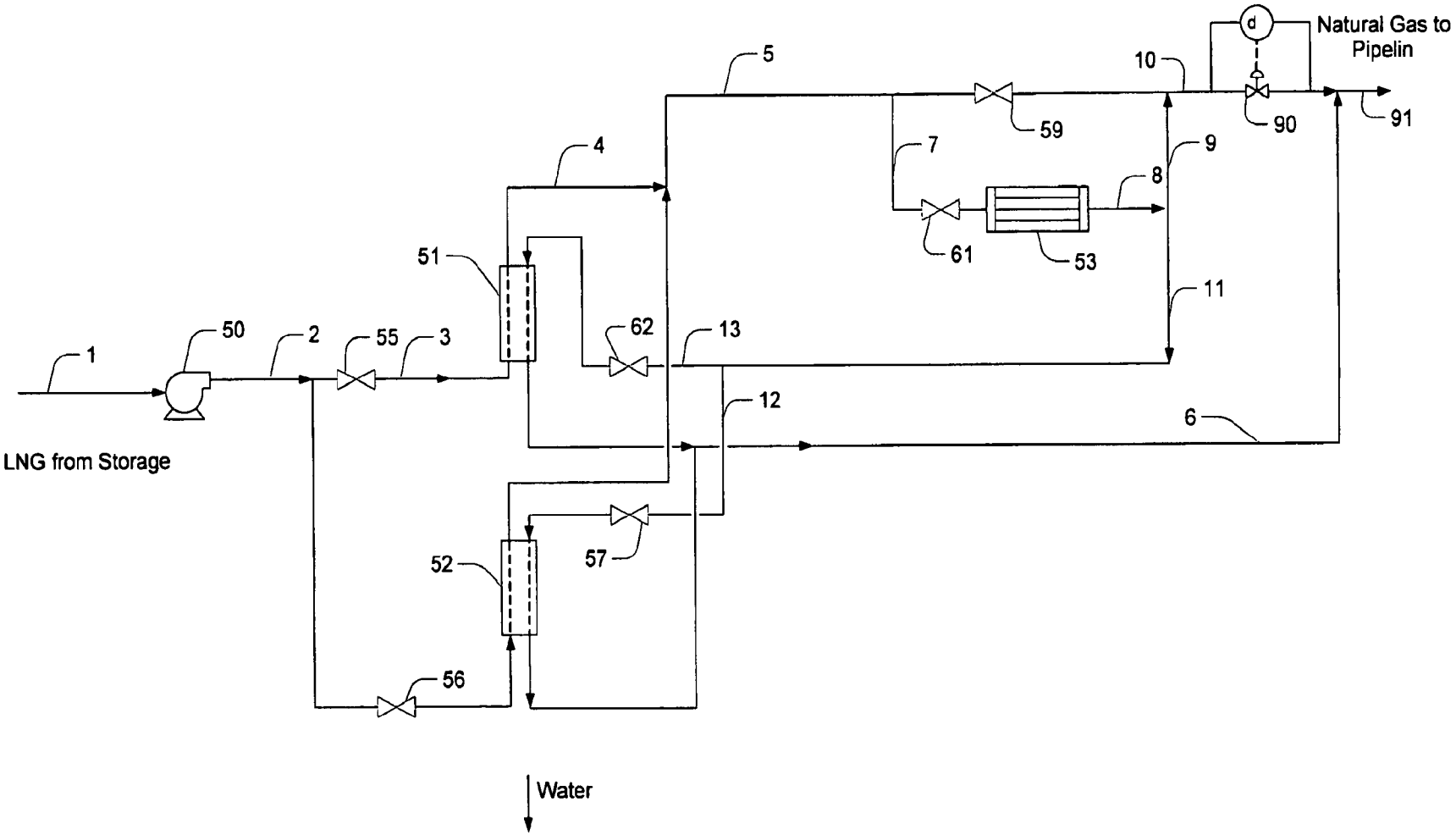
FIG. 2 is a schematic of a second exemplary configuration for an LNG regasification plant with pressure differential valve for recycling the chilled defrosting gas.

Another exemplary process for defrosting ambient air LNG vaporizers is shown in the schematic illustration of FIG. 2 in which like numbers refer to like components of FIG. 1. In this exemplary configuration, it should be appreciated that the compressor 54 of FIG. 1 is not required. Instead, chilled vaporized LNG is fed back to the vaporized LNG product or pipeline via operation of pressure differential valve 90, which avoids the relatively costly compressor and reduces operational complexity. In such configurations, suitable pressure differential is preferably at least about 20 psi, and more typically at least about 25 psi (and in some cases at least 40 psi or even higher) between the vaporizer outlet and pipeline pressure as necessary to maintain defrosting gas flow stream 11 to the ambient air vaporizers and the return flow of the chilled vaporized LNG stream 6. Stream 6 is preferably mixed with the vaporized LNG product at a position downstream of the pressure differential valve 90 to form combined vaporized product stream 91.

It should also be noted that with the use of the contemplated configurations, the use of ambient air for defrosting or use of a force draft fan can be totally eliminated and the time required for the ambient air defrosting process can therefore be completely eliminated, which in turn dramatically reduces (if not even eliminates) the number of ambient air vaporizer required for the standby defrosting operation. In addition to energy savings with the use of waste heat, the number of ambient air vaporizers can be reduced by at least 30%.

Suitable LNG sources include stationary as well as mobile LNG storage devices, and all known LNG storage devices are deemed suitable for use herein. However, it is generally preferred that the storage device is a marine-based device, and particularly contemplated devices include LNG tankers, and offshore floating LNG storage tanks. Therefore, it should be particularly appreciated that ambient air vaporizers will most preferably be mounted on an offshore structure (most typically vertically), which may also include an LNG storage vessel. In less preferred aspects, suitable ambient air vaporizers will further include a system that forces air across the surface of the exchanger tubes by difference in density. Depending on the volume of LNG that is vaporized, multiple vaporizer tubes may operate in series and/or parallel, and it is especially preferred that at least two of the vaporizers will operate in alternating sequence (i.e., one vaporizer operates in vaporization mode while the other operates in defrosting mode).

Regardless of the number of vaporizers and manner of operation, it should be noted that contemplated vaporizers are thermally coupled to one or more defrosting conduits that are configured receive at least a portion of the heated vaporized LNG to thereby allow defrosting of the ambient air vaporizers (and so form chilled vaporized LNG as spent defrosting medium). For example, the defrosting conduit may be the same conduit as the conduit in which the LNG is vaporized. Such configuration is particularly advantageous as the ice layer on the surface of the vaporizer is removed from the inside out, thus allowing the ice layer to simple slide off the surface of the vaporizer. On the other hand, suitable defrosting conduits may also be external to the conduit in which LNG is vaporized and may be thermally coupled to the fin of the exchanger tube (e.g., defrosting conduit disposed within a portion of the fin) and/or to the vaporizing conduit (e.g., defrosting conduit coupled to a portion of the fin or exchanger tube). It should be especially appreciated that in such systems defrosting and vaporization may be performed contemporaneously. Consequently, the recycle conduits that transport the chilled vaporized LNG back to the conduit transporting the vaporized LNG and/or conduit transporting the LNG may vary considerably and may be fluidly coupled to the LNG vaporizing conduit or may be fluidly independent of the LNG vaporizing conduit.

Similarly, the type of heater may vary, and it is generally contemplated that all known heaters are suitable for use herein so long as such heaters will heat at least a portion of the vaporized LNG to a temperature above ambient temperature. However, it is especially preferred that the vaporized LNG is heated to a temperature of at least 100° F., more typically to a temperature of between about 100° F. and about 200° F., and most typically to a temperature of between about 200° F. and about 400° F. As used herein, the term "about" in conjunction with a numeral refers to a range of that numeral starting from 20% below the absolute of the numeral to 20% above the absolute of the numeral, inclusive. For example, the term "about −100° F." refers to a range of −80° F. to −120° F., and the term "about 1000 psig" refers to a range of 800 psig to 1200 psig. Therefore, suitable heaters will include those that employ waste heat from a non-vaporization process (e.g., waste heat from a turbine exhaust, combustion process, or power producing process), or that use a combustion process (e.g., using vaporized LNG as fuel).

Once heated, the vaporized LNG is most preferably directly routed to the defrosting conduits of one or more ambient air vaporizers, however, alternative configurations are also deemed suitable. For example, and especially where the heated vaporized LNG is relatively hot, some of the heat content may be used in an exchanger or by direct injection of hot vaporized LNG to adjust the temperature of any liquid and/or vaporized stream in the regasification facility. After passage through the defrosting conduit of the vaporizer the heated vaporized stream exits as chilled vaporized LNG stream and can be routed one or more locations within the plant. Most preferably, the chilled stream is recycled to the LNG liquid and/or vaporized LNG stream. However, in alternative aspects, at least a portion of the chilled stream may be optionally expanded to generate power and used fuel (e.g., for a heater or turbine). It is preferred that the chilled vaporized LNG is combined with already vaporized LNG (upstream or downstream of heater), for example as temperature control mechanism of defrosting stream that is fed into the vaporizer, and/or that the chilled vaporized LNG is combined with cryogenic LNG.

Where a compressor is used for compression of the chilled vaporized LNG, it should be noted that all known types of compressors are deemed suitable, and that the compressor may be driven by an expander process, especially where the cryogenic LNG is pumped to a pressure above pipeline pressure. Most typically, the compressor is configured to compress the chilled vaporized LNG to natural gas pipeline pressure. Where a pressure differential valve is used, the energy of the pressure letdown can be recovered by a turbo expander.

Therefore, a method of regasifying LNG will generally include feeding LNG to a first ambient air vaporizer to produce vaporized LNG, and heating a portion of the vaporized LNG to a temperature above ambient temperature. Thus, in contemplated configurations and methods, it should be appreciated that the vaporized LNG is used as the defrosting medium. Most preferably, the defrosting medium is heated well above ambient temperature and, after used as defrosting medium, returned back to the LNG production flow. In further preferred aspects of the inventive subject matter, the same or a second air vaporizer is defrosted using at least some of the heated vaporized LNG to form chilled vaporized LNG. Where desirable, another portion of the heated vaporized LNG is used to heat already vaporized LNG prior to delivery to a natural gas pipeline to achieve a desired delivery temperature.

Thus, specific embodiments and applications of LNG vaporization and ambient air vaporizer defrosting have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Furthermore, where a definition or use of a term in a reference, which is incorporated by reference herein is inconsistent or contrary to the definition of that term provided herein, the definition of that term provided herein applies and the definition of that term in the reference does not apply.

What is claimed is:

1. An LNG regasification system, comprising:

an LNG source configured to provide LNG to first and second ambient air vaporizers, wherein the first and second ambient air vaporizers are configured to provide vaporized LNG;

a heater fluidly coupled to the first and second ambient air vaporizers, wherein the heater is configured to receive and heat a portion of the vaporized LNG to a temperature at or above ambient temperature to thereby form a heated vaporized LNG;

wherein first and second ambient air vaporizers are further thermally coupled to respective first and second defrosting conduits that are configured receive at least a portion of the heated vaporized LNG to thereby allow defrosting of the first and second ambient air vaporizers and to thereby form chilled vaporized LNG;

first and second recycle conduits fluidly coupled to the first and second defrosting conduits and configured to feed at least a portion of the chilled vaporized LNG to a conduit transporting the vaporized LNG and a conduit transporting the LNG; and a third recycle conduit fluidly coupled to the defrosting conduits and configured to allow a combination of another portion of the chilled vaporized LNG with the heated vaporized LNG.

2. The system of claim 1, wherein the system is configured to allow alternate operation of the first and second ambient air vaporizers.

3. The system of claim 1,wherein the system is configured to allow a combination of another portion of the heated vaporized LNG with the vaporized LNG.

4. The system of claim l, further comprising a compressor that is configured to compress the chilled vaporized LNG.

5. The system of claim 4, wherein at least one of the first and second recycle conduits are configured to allow a combination of a portion of the compressed chilled vaporized LNC with LNG at a position upstream of the first and second ambient air vaporizers.

6. The system of claim 1, further comprising a pressure differential valve downstream of and fluidly coupled to the first and second ambient air vaporizers and configured such as to allow a predetermined flow of heated vaporized LNG to the first and second ambient air vaporizers.

7. The regasification system of claim 6, wherein the pressure differential valve is configured to maintain a pressure differential of at least 20 psi.

8. The regasification system of claim 6, wherein the first and second recycle conduits are configured to feed the chilled vaporized LNG to the conduit transporting the vaporized LNG at a position downstream of the pressure differential valve.

9. A method of regasifying LNG, comprising:

feeding LNG to a first ambient air vaporizer to thereby produce vaporized LNG, and heating a portion of the vaporized LNG to a temperature above ambient temperature to thereby form a heated portion of the vaporized LNG;

combining the heated portion of the vaporized LNG with a portion of a chilled vaporized LNG to thereby form a temperature-controlled vaporized LNG to so control a defrosting temperature for a second air vaporizer; and defrosting the second air vaporizer using the temperature-controlled vaporized LNG to thereby form the chilled vaporized LNG;

wherein another portion of the chilled vaporized LNG is combined with LNG at a position upstream of both vaporizers and the vaporized LNG from the first ambient air vaporizer.

10. The method of claim 9, further comprising a step of compressing the chilled vaporized LNG.

11. The method of claim 9, wherein the first and second ambient air vaporizers are operated in alternating sequence.

12. The method of claim 9, further comprising a step of using a pressure differential valve to regulate flow of the vaporized LNG to a heater.

13. The method of claim 9, the heated vaporized LNG has a temperature of between 100° F. and 400° F.

14. The method of claim 9, wherein first and second ambient air vaporizers are the same.

* * * * *